US008287161B2

(12) United States Patent
Zhang et al.

(10) Patent No.: US 8,287,161 B2
(45) Date of Patent: Oct. 16, 2012

(54) LED LAMP

(75) Inventors: Yue-Hong Zhang, Shenzhen (CN); Wen-Hsiang Lu, Tu-Cheng (TW); Huai-Shan Gu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/095,897

(22) Filed: Apr. 28, 2011

(65) Prior Publication Data

US 2012/0140495 A1 Jun. 7, 2012

(30) Foreign Application Priority Data

Dec. 6, 2010 (CN) ..... 2010 1 0574526

(51) Int. Cl.
*F21S 8/08* (2006.01)

(52) U.S. Cl. ..... 362/414; 362/249.02; 362/373; 362/294

(58) Field of Classification Search ..... 362/227, 362/228, 249.01, 249.02, 249.11, 294, 327, 362/363, 373, 410–414, 431
See application file for complete search history.

(56) References Cited

U.S. PATENT DOCUMENTS

| | | | | |
|---|---|---|---|---|
| 6,811,347 | B1 * | 11/2004 | Hsieh | 403/300 |
| 7,736,033 | B2 * | 6/2010 | Patel | 362/414 |
| 8,021,027 | B2 * | 9/2011 | Galipeau et al. | 362/431 |
| 8,029,154 | B2 * | 10/2011 | Myer | 362/145 |
| 8,047,682 | B2 * | 11/2011 | Zheng et al. | 362/249.05 |

FOREIGN PATENT DOCUMENTS

| | | |
|---|---|---|
| CN | 101593803 A | 12/2009 |
| CN | 101749579 A | 6/2010 |

* cited by examiner

*Primary Examiner* — Hargobind S Sawhney
(74) *Attorney, Agent, or Firm* — Altis Law Group, Inc.

(57) ABSTRACT

An LED lamp includes a heat sink, a circuit board, a threaded rod, a support post, and a base. The circuit board is fixed to the heat sink. One end of the threaded rod is fixed to the heat sink, and the opposite end of the threaded rod is fixed to one end of the support post. An opposite end of the support post is fixed to the base. The threaded rod, the support post, and the base are made of heat dispersing material with good heat conductivity. Heat generated by the circuit board is transferred directly to the threaded rod, or is transferred via the heat sink to the threaded rod, and the support post and the base.

5 Claims, 3 Drawing Sheets

LED LAMP

BACKGROUND

1. Technical Field

The present disclosure relates to lamps and, particularly, to an LED lamp with effective heat dispersion.

2. Description of Related Art

To meet aesthetic requirements, light-emitting diodes (LEDs) used in lamps are often covered or shielded by a portion of the lamp such as a lampshade. When an LED lamp is used, heat is generated by the LEDs in the LED lamp, which has a negative influence on the lifetime and the luminous efficiency of the LED lamp. Therefore, an LED lamp with effective heat dispersion is needed.

BRIEF DESCRIPTION OF THE DRAWINGS

Many aspects of the embodiments can be better understood with reference to the following drawings. The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
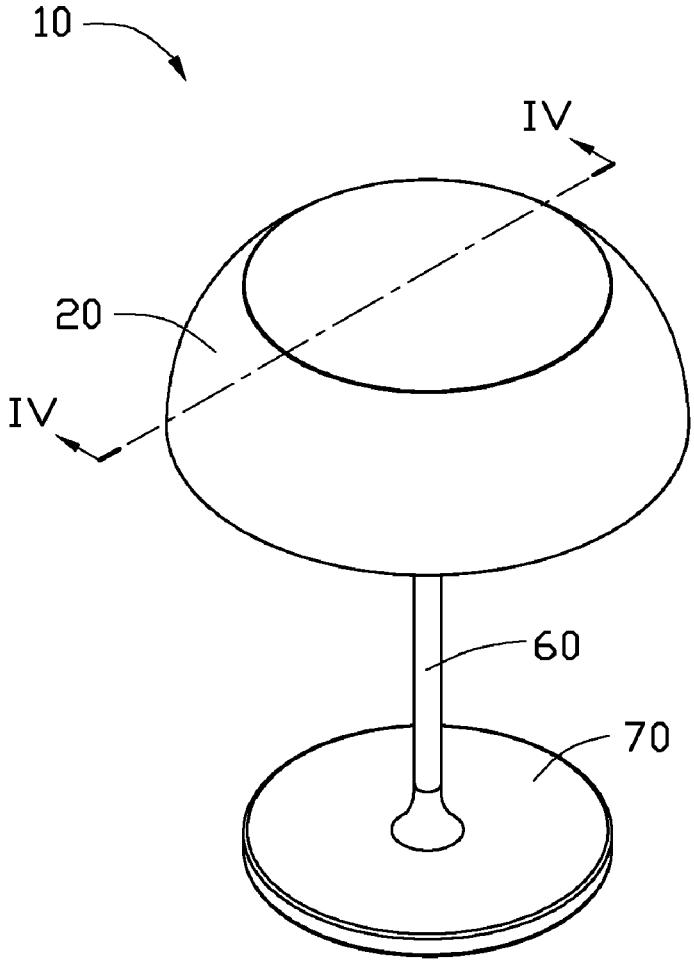
FIG. 1 is an isometric view of an LED lamp according to an embodiment.
Figure 2:
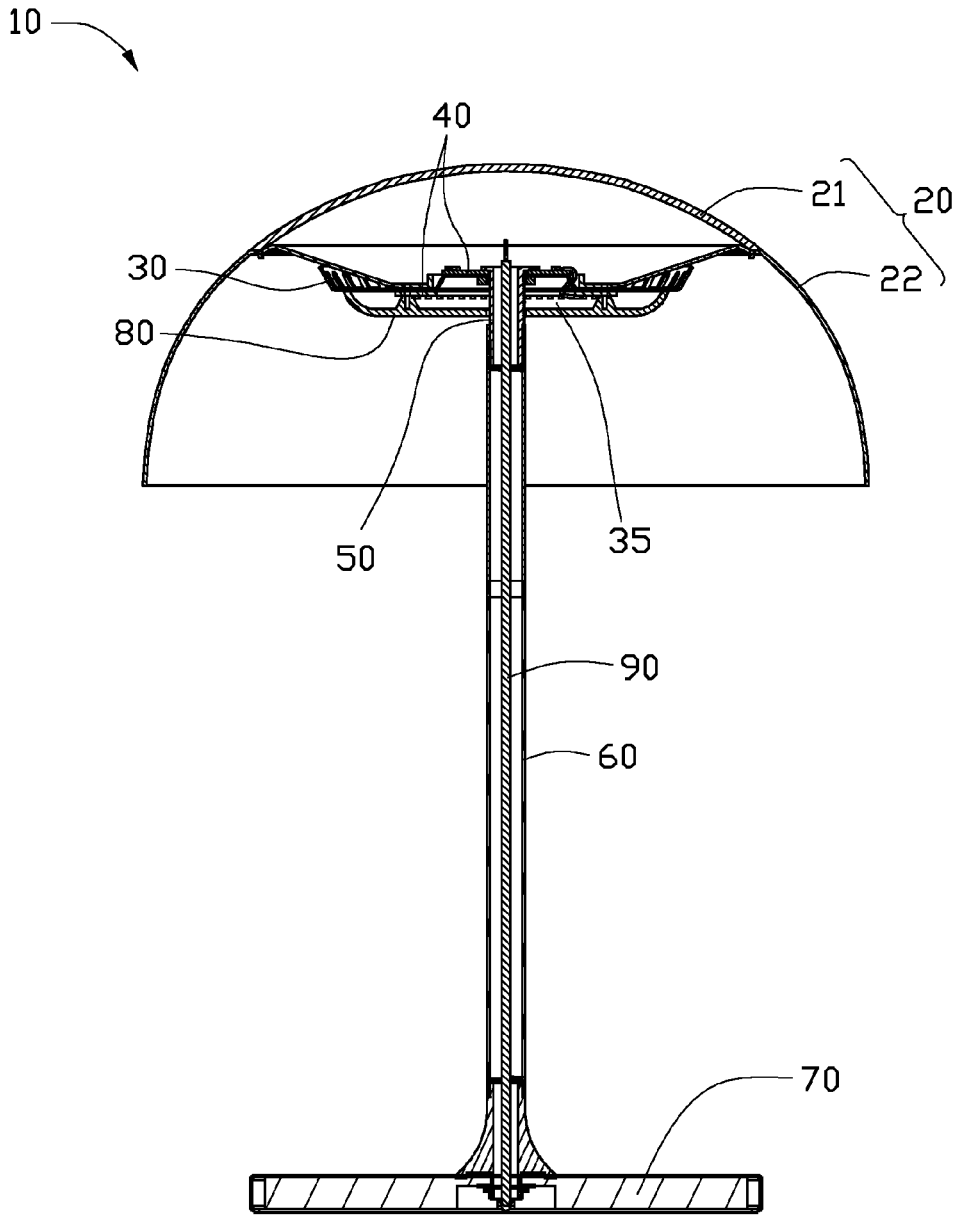
FIG. 2 is a cross-sectional view taken along line IV-IV of the LED lamp of FIG. 1.

Referring to FIGS. 1 and 2, an LED lamp 10 includes a lampshade 20, a heat sink 30, a circuit board 40, a threaded rod 50, a support post 60, and a base 70. The lampshade 20 and the circuit board 40 are fixed to the heat sink 30. One end of the threaded rod 50 is fixed to the circuit board 40 and the heat sink 30, and the opposite end of the threaded rod 50 is fixed to one end of the support post 60. The opposite end of the support post 60 is fixed to the base 70.

Figure 3:
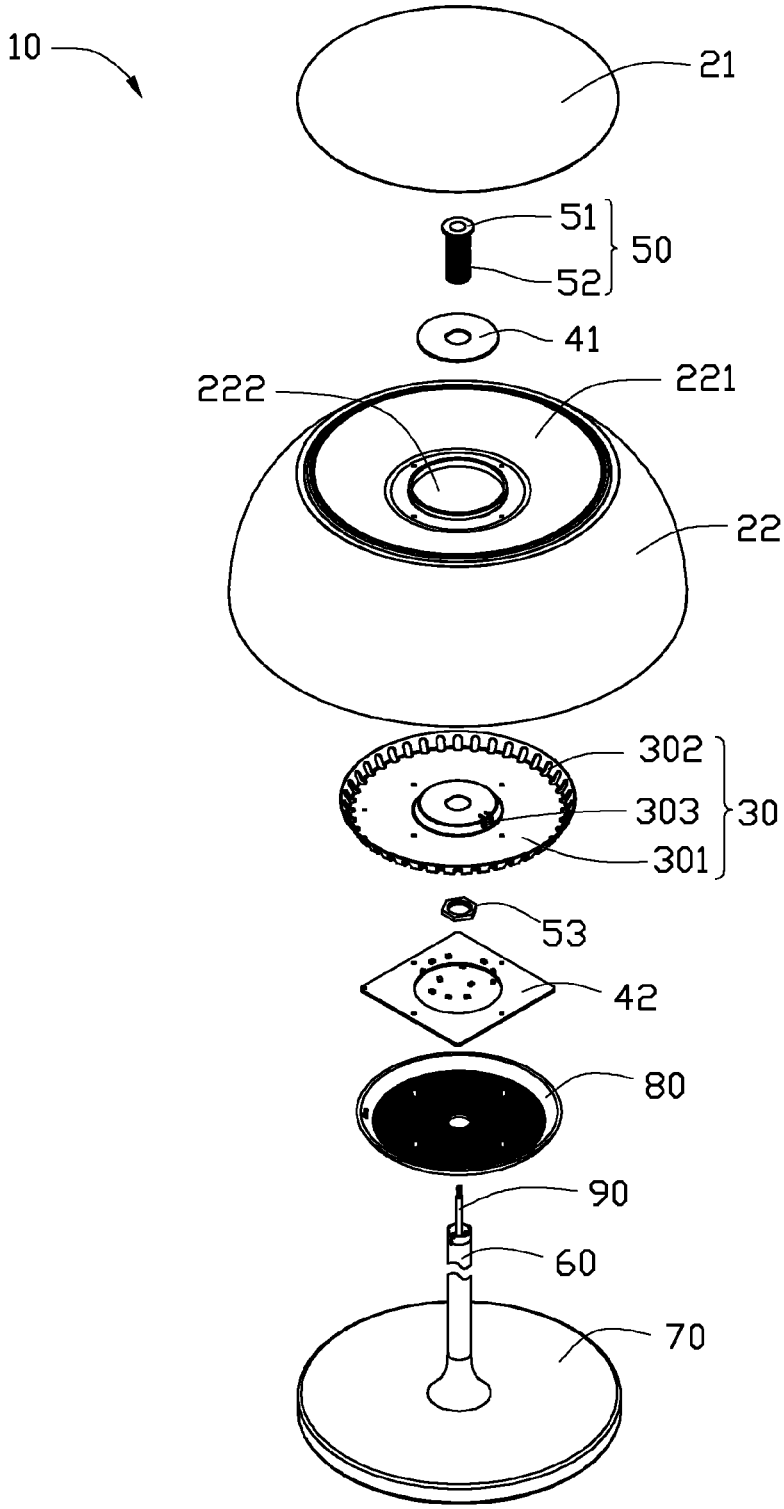
FIG. 3 is an exploded view of the LED lamp of FIG. 1.

In the embodiment, the lampshade 20 includes a first lampshade 21 and a second lampshade 22 fixed to the first lampshade 21. Referring also to FIG. 3, in the embodiment, the top of the second lampshade 22 defines a recess 221, and the recess 221 defines a through-hole 222 in its center.

The heat sink 30 includes a bottom 301, a heat diffusion wall 302 protruding from and extending around the periphery of the bottom 301, and a convex portion 303 protruding from the center of the bottom 301. In assembly, the convex portion 303 passes through the through-hole 222, and the bottom of the recess 221 of the lampshade 22 is partly received in the bottom 301.

The circuit board 40 includes a first circuit board 41 and a second circuit board 42. In the embodiment, the first circuit board 41 is arranged on the top of the convex portion 303 of the heat sink 30, and the second circuit board 42 is arranged on a surface of the bottom 301 away from the first circuit board 41. A number of LEDs are distributed on a surface of the first circuit board 41 and a surface of the second circuit board 42 away from the heat sink 30.

The LED lamp 10 further includes a transparent cover 80 fixed to the bottom 301 of the heat sink 30. A heat diffusion chamber 35 is defined between the heat sink 30 and the cover 80.

The threaded rod 50 includes a head 51 and a threaded shank 52. Threads are formed in the lateral surface of the threaded shank 52, to increase a contact area between the threaded rod 50 and the air in the heat diffusion chamber 35. In the embodiment, the centers of the heat sink 30, the first circuit board 41, the second circuit board 42 and the cover 80 each define a through-hole. The threaded shank 52 extends through the through-holes of the first circuit board 41, the heat sink 30, the second circuit board 42, and the cover 80. The head 51 abuts against the first circuit board 41. A nut 53 engages the threaded shank 52 and abuts against a surface of the convex portion 303 of the heat sink 30 away from the first circuit board. The first circuit board 41 is thus fixed to the heat sink 30.

The threaded rod 50 and the support post 60 are both hollow tubular structures to contain cables 90 of the LED lamp 10. Threads (not shown) are formed in the inner lateral surface of one end of the support post 60, to engage the threads of the threaded rod 50.

In the embodiment, the threaded rod 50, the support post 60, and the base 70 are made of heat dispersing material with good heat conductivity, such as aluminium alloy. Heat generated by the circuit board 40 can be transferred directly to the threaded rod 50, or be transferred via the heat sink 30 to the threaded rod 50, and finally be transferred to the support post 60 and the base 70.

Specifically, a portion of the heat generated by the circuit board is transferred to the heat diffusion wall 302 of the heat sink 30 through the bottom 301 and convex portion 303, and is dissipated to the air. A portion of the heat is transferred to the threaded rod 50 directly through the heat sink 30 or through the air in the heat diffusion chamber 35. The heat transferred to the threaded rod 50 is further transferred to the support post 60 and the base 70, and is finally dissipated to the air.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An LED lamp comprising:

a heat sink;

a circuit board fixed to the heat sink;

a cover fixed to the heat sink, wherein a heat diffusion chamber is defined between the heat sink and the cover;

a threaded rod comprising a first end, an opposite second end and a threaded shank, the first end fixed to the heat sink; the threaded shank extending through the circuit board, the heat sink, and the cover, wherein threads are formed in the lateral surface of the threaded shank, to increase a contact area between the threaded rod and the air in the heat diffusion chamber; and a support post and a base, wherein one end of the support post is fixed to the second end of the threaded rod, and an opposite end of the support post is fixed to the base;

wherein, the threaded rod, the support post, and the base are made of heat dispersing material with good heat conductivity, heat generated by the circuit board is transferred directly to the threaded rod, and is transferred via the heat sink to the threaded rod, and then is transferred to the support post and the base.

2. The LED lamp of claim 1, wherein the heat sink comprises a bottom and a convex portion protruding from the bottom.

3. The LED lamp of claim 2, wherein the circuit board comprises a first circuit board arranged on the top of the convex portion and a second circuit board arranged on a surface of the bottom away from the first circuit board.

4. The LED lamp of claim 3, wherein the threaded rod further comprises a head abutting against the first circuit board, a nut engages the threaded shank and abuts against a surface of the convex portion of the heat sink away from the first circuit board, to fix the first circuit board to the heat sink.

5. The LED lamp of claim 1, wherein the threaded rod and the support post are both hollow tubular structures to contain cables of the LED lamp.

* * * * *